United States Patent [19]

Shotwell

[11] 3,992,830

[45] Nov. 23, 1976

[54] STRUCTURAL PANEL

[76] Inventor: Samuel H. Shotwell, R.D. No. 3, Pottstown, Pa. 19464

[22] Filed: May 20, 1975

[21] Appl. No.: 579,107

Related U.S. Application Data

[63] Continuation of Ser. No. 382,936, July 26, 1973, abandoned.

[52] U.S. Cl. ..... 52/81; 52/656; 52/664

[51] Int. Cl.[2] ..... E04C 2/38; E04B 7/10

[58] Field of Search ..... 52/664, 633, 636, 656, 52/615, 225, 226, 80, 81, 86, 88, 656, 660, 63, 581, 648, 663, 691, 693, 601, 692, 693, 659, 600, 626; D13/1 J; 256/21, 22

[56] References Cited

UNITED STATES PATENTS

| | | | |
|---|---|---|---|
| 893,640 | 7/1908 | Moccetti | 52/659 |
| 998,479 | 7/1911 | Eisen | 52/236 |
| 1,539,954 | 6/1925 | Respess | 52/22 |
| 1,638,636 | 8/1927 | Lachman | 52/695 |
| 1,759,710 | 5/1930 | Pohland | 52/668 |
| 2,515,267 | 7/1950 | Salisbury | 52/663 X |
| 2,961,802 | 11/1960 | Mongan | 52/222 X |
| 3,092,932 | 6/1963 | Wilson | 52/660 X |
| 3,312,033 | 4/1967 | Williams | 52/615 |
| 3,534,519 | 10/1970 | James | 52/581 |
| 3,716,955 | 2/1973 | Loupere | 52/227 |

FOREIGN PATENTS OR APPLICATIONS

| | | | |
|---|---|---|---|
| 219,917 | 1/1959 | Australia | 52/615 |
| 787,002 | 9/1935 | France | 52/615 |
| 1,037,971 | 9/1953 | France | 52/664 |
| 1,143,497 | 10/1957 | France | 52/615 |
| 831,903 | 7/1949 | Germany | 52/601 |

*Primary Examiner*—John E. Murtagh
*Attorney, Agent, or Firm*—Stuart E. Beck

[57] ABSTRACT

A novel structural panel comprising a frame and two sets of overlapping or intersecting arch members within the interior of the frame is disclosed. The middle portions of the first set of arch members are securely fastened to the middle portion of a first base member of the rectangular frame, while the middle portions of the second set of arch members are securely fastened to the middle portion of the opposing base side of the frame. The ends of the arch members are securely fastened to the interior surface of the frame. Alternatively, a plurality of separate side-by-side single-set panels may be utilized, one having only arch members opening downwardly and the next having arch members only opening upwardly.

23 Claims, 4 Drawing Figures

STRUCTURAL PANEL

This is a continuation of application Ser. No. 382,936, filed July 26, 1973, now abandoned.

BACKGROUND OF THE INVENTION

This invention relates to structural panels, and more particularly to those adapted for applications requiring a high strength.

In the building construction field, the two optimum attributes for building materials of high strength and low cost have generally been mutually countervailing. In order to obtain high structural strength it has heretofore been necessary to use a large amount of, or relatively costly materials. Attempts have often been made to develop structural panels and other building materials with a high structural strength yet with a relatively low cost, assembled from a small amount of simple tools and equipment and little labor; but results in this direction have generally been disappointing.

What is needed in a stronger, lighter, and simpler structure adaptable to a wide variety of applications which can be mass produced with little know-how, less expensive equipment, and less labor and material. The problem that is currently facing the construction industry of high cost, transportation problems, increased breakage, added field work, and re-working necessary, necessitates a new and different approach; one that uses less material rather than cheaper material, one that uses less labor rather than cheaper labor, and one that uses less expensive equipment rather tham more expensive equipment.

The necessity for a simple type of structure is emphasized by the fact that the average level of skill of new workman in the construction field is much less than it was decades ago. The normal amount of apprentice time is negligible resulting in shoddy work in any structural building requiring a high degree of skill. Additionally, normal construction material prices are always increasing. New techniques that would speed the construction of homes and save material would be greatly welcomed in the industry. Quicker, more sturdy construction will lead to less maintainance and quicker turnover of capital will save interest on construction loans which will further help the construction industry. Also, a new design which would lead to greater freedom of design in construction would break up the monotony of current housing developments and increased buyer appeal.

Any type of new structure which would eliminate complicated construction, having members such as footings, foundations, box sills, heavy beams, heavy floor joist, ceiling joist, complicated trusses, complicated rafters, and any other involved items including separate pieces of interior and exterior trim would be greatly welcomed by the construction industry.

SUMMARY OF THE INVENTION

Accordingly, it is among the objects of this invention to provide a structural panel which though quite high in strength is capable of being assembled from a small amount of simple materials, using simple tools and equipment and little labor.

This and other objects is achieved with a structural panel comprising a generally planar frame and two overlapping or intersecting sets of oppositelybowed arch members defining a network within the interior of the frame, the arch members being generally co-planar with the frame and having their ends securely fastened to the interior surface of the frame. One set of arch members has each of the middle portions of the arch members securely fastened to the middle portion of a base side of the frame, while the other set of arch members has the middle portion of each arch member securely fastened to the middle portion of an opposing side of the frame.

Alternatively, a plurality of separate side-by-side single-set panels may be utilized, one having only arch members opening downwardly and the next having arch members only opening upwardly. The maximum strength of a series of such panels is unlimited. By inverting every other panel, many such frames can be alternated to build up the desired thickness and strength wanted by layering.

The construction of such a structural panel can be achieved by using inexpensive materials such as wood, plastic, steel, aluminum, or the like, of solid, hollow, or tubular construction. Loads applied to a base side against which arch middle portions are secured will be distributed by the arches to and throughout the entire frame; thus providing a structural panel with a strength that could only otherwise be achieved by the use of much more costly materials.

The arch members may either be a single strip extending across the frame, or may be segmented each arch member being a pair of strips joined together at and fastened against the middle portion of a base side of the frame.

DESCRIPTION OF THE PREFERRED EMBODIMENT

Figure 1:
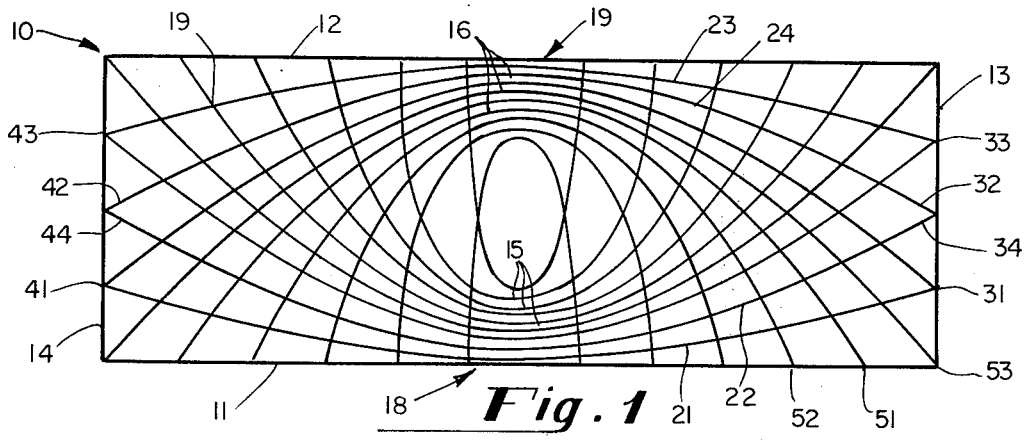
FIG. 1 is a schematic illustration of a rectangular embodiment of the structural panel of the present invention, with the middle portions of each set of arch members, attached to each other and a frame side in an actual panel, being shown separated from each other here for clarity.

Referring to the figures, schematic illustrations of the structural panel of the present invention are shown. Although the embodiment illustrated in the figures is of a rectangular shape, of a type that would be utilizable in a modular construction of houses, actually any geometric configuration of the outer frame would be suitable, such as the trapezoidal and triangular forms shown in FIG. 4 for the construction of dome-shaped structures.

Alternatively, a plurality of separate side-by-side single-set panels may be utilized, one having only arch members opening downwardly and the next having arch members only opening upwardly.

A frame 10 consisting of first base side 11, second base side 12, and end sides 13 and 14 encloses an arch member network defined by two sets of oppositely-bowed arch members 15 and 16. By "oppositely-bowed arch members" is meant arch members having their concave portions opening into a direction 180° apart from each other, the concave portions being generally co-planar with the frame of the structural panel. The arch members of opposing sets 15 and 16 cross each other at many points within the interior of the frame, such as at 19, to form the network. In a frame which has a thickness at least twice that of the arch members, opposing arch members would overlap each other at crossing points such at 19 to form the network. Where the arch members have a thickness about equal to that of the frame, opposing arch members would intersect each other at crossing points such as 19, to form the network, fitting together and fastened at these points by means of corresponding half-thickness notches in the arch members or similar means. At their intersection points 19, the arch members may be knotted together with cord, fastened with crimped locks, or otherwise mutually secured.

Figure 2:
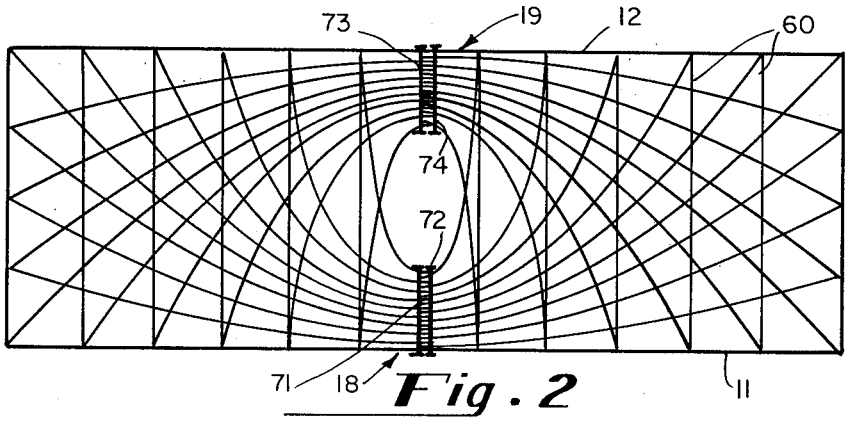
FIG. 2 shows the structural panel of FIG. 1, having two additional modifications, segmented arches, and linear support members.

The middle portions of the arch members of the first set 15 are fastened to each other and to middle portion 18 of first base member 11 by suitable fastening means, not shown in FIG. 1, in FIG. 2 illustrated by bolts 71 and 72. Of the first set 15, first arch member 21 is secured directly to middle portion 18 of first base side 11, while middle portion of second arch member 22 of the first set is secured to the interior surface of the middle portion of arch member 21. In like manner, each interiorly succeeding arch member is secured to the arch member immediately preceding it. By interiorly succeeding is meant proceeding in a direction from the frame to the center of the interior of the frame. First set of arch members 15 are all bowed so that they open toward second base side 12.

Second set of arch members 16 are all bowed so that they open toward first base member 11. Of the second set, first arch member 23 is fastened at its middle portion directly to middle portion 19 of second base side 12, while the middle portion of second arch member 24 of the second set is fastened to the interior surface, the surface facing towards the interior of the structural panel, of first arch member 23. In like fashion, each succeeding arch member is fastened to the interior surface of the preceding arch member.

The ends of the arch members are all securely fastened to the interior surfaces of the frame sides. Some arch members may be fastened to the frame sides alone as end 51 is, or two opposing arch members may be fastened at a frame side together, such as ends 32 and 34, and 42 and 44. Some arch member ends may be attached to the frame side adjacent a base side, such as ends 31, 32, 33 and 34, or they may be attached to a frame side more remote from the base side at which their middle portions are fastened, such as ends 51 and 52. Some frame ends may even be fastened at a junction of two frame sides such as end 53.

FIG. 2 shows a structural panel according to the present invention with two additional modifications; linear support members, and segmented arch members. For those applications requiring an even greater structural strength than the panel of FIG. 1, linear support members 60 may be fastened by glue or otherwise between opposing frame sides, as shown in FIG. 2 between base sides 12 and 11. At intersection points 19 with linear members 60, the arch members may be knotted to each other and the linear members with cord, fastened with crimped locks, or otherwise mutually secured.

Figure 3:
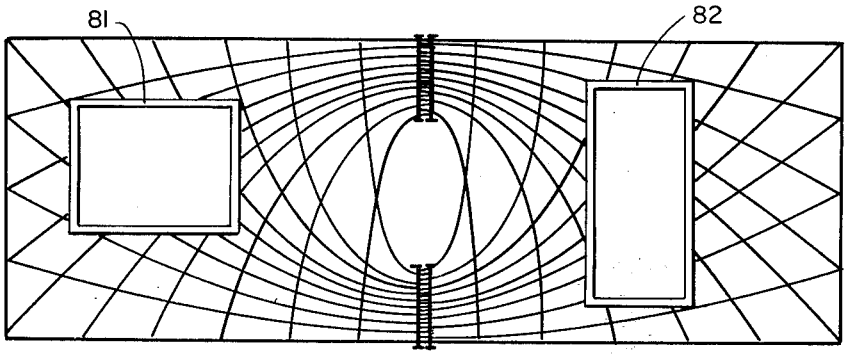
FIG. 3 shows the structural panel of FIG. 2, without the linear support members, with an additional modification of a door frame and a window frame within the interior of the panel positioned within corresponding cutouts from the arch member network.

As shown in FIG. 2, rather than being continuous, the arch members are shown segmented into two equal parts, both parts being joined together over center portions 18 and 19 of base sides 11 and 12, by suitable fastening means, shown in FIG. 2 by bolts 71 and 72. FIG. 3 shows a modification also with segmented arch members, and in addition a window frame 81 and a door frame 82 positioned within the interior of the structural panel. These frames are securely fastened within cut-outs formed within the interior of the structural panel by cutting out or otherwise removing that portion of the arch member network into which the frame is to be positioned. The then loose ends of the arch member network are securely fastened to the outer surface of the window or door frames, thus retaining the structural integrity of the panel.

Figure 4:
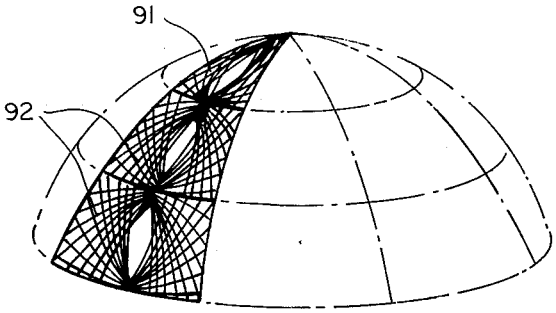
FIG. 4 is a schematic illustration of modified embodiments of the present invention utilizable in construction of dome-like structures, employing frames of both trapezoidal and triangular configurations.

For use in building dome-like structures, structural panels of the present invention of a triangular and trapezoidal configuration may be utilized. As shown in FIG. 4, the topmost portion of the dome is composed of structural panels 91 of a triangular shape, while lower portions of the dome are composed of frames of a trapezoidal configuration, such as 92. Other shapes of frames may likewise be utilizable for other adaptations within the principle of the present invention.

Many other modifications are also possible. Either or both sides of the structural panel may be covered with suitable sheet material such as wire or nylon mesh covered with mastic or other plastic finishing, for use as ceilings or walls. Additionally, the sheet material may be fastened not only to the frame, but also to the arch members with which it comes in contact, thus increasing even further the structural strength of the panel. The sets of opposing arch members of the present invention may either pass over and under each other, or actually intersect by means of notches where they join. Alternatively, the arch members may be stamped or molded or otherwise formed from the covering sheet material itself.

The structural panels of the present invention, in addition to being constructed of rigid materials, may be constructed of rigid and non-rigid materials. For example, in place of the bowed arch members of the structural panel of the present invention being constructed of rigid materials, they may be constructed of pre-stressed nylon rope or wire cable knotted or fastened to linear members 60 at intersection points 19. Or, the arch members may be formed from pre-stressed wire mesh overlaid with mastic, plastic, or other suitable setting material.

Although specific forms of the present invention have been selected for illustration and the drawings and the above detailed description is drawn in specific terms for the purpose of describing these forms of the invention, this description is not intended to limit the scope of the invention which is defined in the appended claims. It will be understood that various changes in the details, materials, and arrangement of parts which have been described and illustrated above in order to explain the nature of this invention, may be made by those skilled in the art within the principle and scope of the invention as described in the appended claims.

I claim:

1. A structural panel comprising a frame and two sets of oppositely-bowed arch members which overlap each other to define a network within the interior of said frame, said arch members being generally co-planar with said frame and having their ends securely fastened to an interior surface of said frame, the middle portion of one arch member in each of said sets being fastened to and being in load supporting engagement with said frame, and the middle portion of each of the interiorly successive arch members in each set is fastened to and is in load supporting engagement with the middle portion of the next adjacent arch member in that set.

2. A structural panel according to claim 1 further comprising at least one window frame securely positioned within a corresponding cut-out from said arch member network within the interior of said frame.

3. A structural panel according to claim 1 further comprising at least one door frame securely positioned within a corresponding cut-out from said arch member network within the interior of said frame.

4. A structural panel according to claim 1 further comprising a plurality of linear support members having their ends securely fastened to an interior surface of said frame.

5. A structural panel according to claim 1 wherein said arch members are an integral part of sheet material which at least partially covers said frame and said arch members.

6. A structrual panel according to claim 4, wherein said ends of said linear support members are fastened to the ends of said arch members.

7. A structural panel comprising a frame and two sets of oppositely-bowed arch members which overlap each other to define a network within the interior of said frame, said arch members being generally co-planar with said frame, and the mid portion and ends of each of said arch members are securely fastened to said frame.

8. A plurality of structural panels according to claim 7, in mutual combination defining a structure.

9. A plurality of structural panels according to claim 7, wherein said frame of each is of a triangular shape, in mutual combination defining a domed-shaped structure.

10. A plurality of structural panels according to claim 7, of varying sizes, wherein said frame of each is of a trapezoidal shape, in mutual combination defining a domed-shaped structure.

11. A structural panel according to claim 7 further comprising sheet material at least partially covering said frame and said arch members.

12. A structural panel according to claim 11 wherein said arch members are also fastened to said covering sheet material.

13. A structural panel according to claim 7, wherein said frame is of a rectangular shape.

14. A structural panel according to claim 7, wherein said frame is of a trapezoidal shape.

15. A structural panel, comprising:

a rectangular frame, having a first base side, a second base side, and two ends;

a first set of arch members having their ends securely fastened to the interior surfaces of said second base side and said two end sides, the first member of said first set of arch members having a middle portion thereof securely fastened to the interior surface of a middle portion of said first base side, each interiorly successive arch member of said first set having a middle portion thereof securely fastened to the interior surface of a middle portion of the preceding arch member of the first set;

a second set of arch members having their opposing ends securely fastened to the interior surfaces of said first base side and said two end sides, the first member of said second set of arch members having a middle portion thereof securely fastened to the interior surface of a middle portion of said second base side, each interiorly successive arch member of said second set having the middle portion thereof securely fastened to the interior surface of a middle portion of the preceding arch member of the second set; and said first and second sets of arch members overlap each other.

16. A structural panel comprising a frame and two sets of oppositely-bowed arch members which intersect each other to defein a network within the interior of said frame, said arch members being generally co-planar with said frame, and the mid portion and ends of each of said arch members are securely fastened to said frame.

17. A plurality of structural panels according to claim 16, in mutual combination defining a structure.

18. A plurality of structural panels according to claim 16, wherein said frame of each is of a triangular shape, in mutual combination defining a domed-shaped structure.

19. A plurality of structural panels according to claim 16, of varying sizes, wherein said frame of each is of a trapezoidal shape, in mutual combination defining a domed-shaped structure.

20. A structural panel according to claim 16 further comprising sheet metal at least partially covering said frame and said arch members.

21. A structural panel according to claim 20 wherein said arch members are also fastened to said covering sheet material.

22. A structural panel according to claim 16, wherein said frame is of a rectangular shape.

23. A structural panel according to claim 16, wherein said frame is of a trapezoidal shape.

* * * * *